US010621843B2

(12) United States Patent
Bergman et al.

(10) Patent No.: US 10,621,843 B2
(45) Date of Patent: Apr. 14, 2020

(54) SYSTEMS AND METHODS FOR RADIO FREQUENCY IDENTIFICATION ENABLED DEACTIVATION OF ACOUSTO-MAGNETIC RESONATOR

(71) Applicants: Adam S. Bergman, Boca Raton, FL (US); Manuel Soto, Lake Worth, FL (US); Ronald B. Easter, Parkland, FL (US); Thomas Solaski, Boca Raton, FL (US)

(72) Inventors: Adam S. Bergman, Boca Raton, FL (US); Manuel Soto, Lake Worth, FL (US); Ronald B. Easter, Parkland, FL (US); Thomas Solaski, Boca Raton, FL (US)

(73) Assignee: SENSORMATIC ELECTRONICS, LLC, Boco Raton, FL (US)

( * ) Notice: Subject to any disclaimer, the term of this patent is extended or adjusted under 35 U.S.C. 154(b) by 0 days.

(21) Appl. No.: 15/939,015

(22) Filed: Mar. 28, 2018

(65) Prior Publication Data

US 2019/0304277 A1 Oct. 3, 2019

(51) Int. Cl.
*G08B 13/24* (2006.01)

(52) U.S. Cl.
CPC ..... *G08B 13/2425* (2013.01); *G08B 13/246* (2013.01)

(58) Field of Classification Search
CPC ..... G08B 13/2425; G08B 13/246
See application file for complete search history.

(56) References Cited

U.S. PATENT DOCUMENTS

| | | | | |
|---|---|---|---|---|
| 5,739,754 | A * | 4/1998 | Schrott | G08B 13/1409 340/551 |
| 6,788,205 | B1 * | 9/2004 | Mason | A47F 9/047 235/383 |
| 2009/0051491 | A1 * | 2/2009 | Lu | H04B 5/0087 340/10.1 |
| 2011/0205030 | A1 * | 8/2011 | Amtmann | G08B 13/242 340/10.5 |
| 2013/0313327 | A1 * | 11/2013 | Wu | G06K 19/06 235/492 |
| 2015/0262463 | A1 * | 9/2015 | Piccoli | E05B 73/0017 340/572.8 |
| 2018/0189770 | A1 * | 7/2018 | Vuille | G04G 21/04 |

* cited by examiner

*Primary Examiner* — Hongmin Fan
(74) *Attorney, Agent, or Firm* — Arent Fox LLP

(57) ABSTRACT

Systems and methods for operating a marker. The method comprising: receiving, by a communications element of the marker, a marker deactivation signal from an external device; and causing a coil surrounding at least the marker's resonator to be shorted in response to the marker deactivation signal, by supplying power to a deactivation element so that the deactivation element switches from an open state to a closed state. In some scenarios, the power is supplied by an energy harvesting element disposed in the marker.

20 Claims, 8 Drawing Sheets

SYSTEMS AND METHODS FOR RADIO FREQUENCY IDENTIFICATION ENABLED DEACTIVATION OF ACOUSTO-MAGNETIC RESONATOR

BACKGROUND

Statement of the Technical Field

The present disclosure relates generally to Radio Frequency Identification ("RFID") systems. More particularly, the present disclosure relates to implementing systems and methods for RFID enabled deactivation of Acousto-Magnetic ("AM") resonators.

Description of the Related Art

A typical Electronic Article Surveillance ("EAS") system in a retail setting may comprise a monitoring system and at least one security tag or marker attached to an article to be protected from unauthorized removal. The monitoring system establishes a surveillance zone in which the presence of security tags and/or markers can be detected. The surveillance zone is usually established at an access point for the controlled area (e.g., adjacent to a retail store entrance and/or exit). If an article enters the surveillance zone with an active security tag and/or marker, then an alarm may be triggered to indicate possible unauthorized removal thereof from the controlled area. In contrast, if an article is authorized for removal from the controlled area, then the security tag and/or marker thereof can be deactivated and/or detached therefrom. Consequently, the article can be carried through the surveillance zone without being detected by the monitoring system and/or without triggering the alarm.

The security tag or marker generally consists of a housing. The housing is made of a low cost plastic material, such as polystyrene. The housing is typically manufactured with a drawn cavity in the form of a rectangle. A resonator and bias element are disposed within the housing. In the presence of an interrogation signal generated by the EAS system, the resonator produces a resonant signal with a particular amplitude that is detectable by the monitoring system.

Conventional deactivation processes for EAS security tags or markers are not convenient for self or mobile checkout due to high power and complexity of the deactivation electronics required to deactivate the same. Many attempts have been made to find alternative solutions to deactivate EAS security tags or markers without success.

SUMMARY

The present disclosure generally concerns implementing systems and methods for operating or deactivating a marker (e.g., an EAS marker). The methods comprise: receiving, by a communications element of the marker (e.g., a Radio Frequency Identification ("RFID") enabled device or a Near Field Communication ("NFC") enabled device), a marker deactivation signal from an external device; and causing a coil surrounding at least the marker's resonator to be shorted in response to the marker deactivation signal. The coil is shorted by supplying power from the communications element or an energy harvesting element to a deactivation element so that the deactivation element switches from an open state to a closed state.

In some scenarios, the marker deactivation signal is transmitted from a Point Of Sale ("POS") terminal. The marker deactivation signal may be transmitted in response to a successful purchase transaction of an article to which the marker is coupled.

In those or other scenarios, the deactivation element comprises a switch connected in series with the coil. The switch is configured to (a) transition from an open position to a closed position when power is supplied thereto, and (b) remain in the closed position when power is removed.

In those or other scenarios, the method further comprises: receiving, by the communications element, a marker activation signal transmitted from the external device or another external device; and supplying power from the communications element or energy harvesting element to the deactivation element so that the deactivation element switches from the closed state to the open state, in response to the marker activation signal's reception. The supply of power to the deactivation element is once again discontinued after the deactivation element switches to the open state. The deactivation element remains in the open state when power is removed.

BRIEF DESCRIPTION OF THE DRAWINGS

The present solution will be described with reference to the following drawing figures, in which like numerals represent like items throughout the figures.

DETAILED DESCRIPTION

Figure 1:
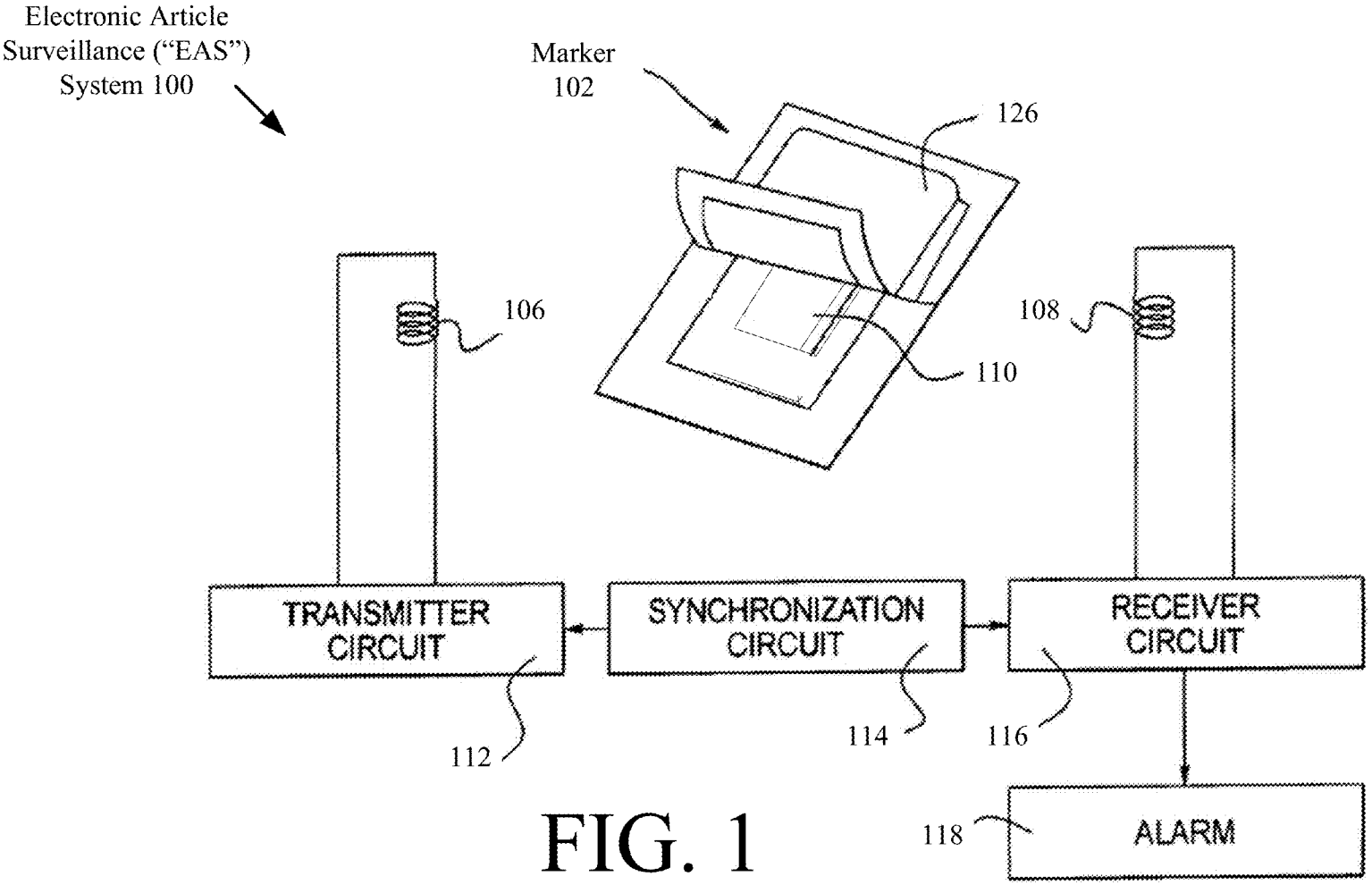
FIG. 1 is an illustration of an illustrative architecture for a EAS system comprising at least one marker.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present solution may be embodied in other specific forms without departing from its spirit or essential characteristics. The described embodiments are to be considered in all respects only as illustrative and not restrictive. The scope of the present solution is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present solution should be or are in any single embodiment of the present solution. Rather, language referring to the features and advantages is understood to mean that a specific feature, advantage, or characteristic described in connection with an embodiment is included in at least one embodiment of the present solution. Thus, discussions of the features and advantages, and similar language, throughout the specification may, but do not necessarily, refer to the same embodiment.

Furthermore, the described features, advantages and characteristics of the present solution may be combined in any suitable manner in one or more embodiments. One skilled in the relevant art will recognize, in light of the description herein, that the present solution can be practiced without one or more of the specific features or advantages of a particular embodiment. In other instances, additional features and advantages may be recognized in certain embodiments that may not be present in all embodiments of the present solution.

Reference throughout this specification to "one embodiment", "an embodiment", or similar language means that a particular feature, structure, or characteristic described in connection with the indicated embodiment is included in at least one embodiment of the present solution. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

The present solution generally concerns a combined tag or marker which includes both RFID component(s) and AM component(s). The novelty of the present solution is that there is a connection between the RFID component(s) (e.g., an RFID chip) and the AM component(s). This connection allows the RFID component(s) to receive from a Point Of Sale ("POS") messages identifying products that have been successfully purchased. In response to these messages, the RFID component(s) performs operations to disable the AM component(s) such that the AM feature the tag or marker is deactivated.

Illustrative EAS System

Referring now to FIG. 1, there is provided a schematic illustration of an illustrative EAS system 100. The EAS system 100 comprises a monitoring system 106-112, 114-118 and at least one marker 102. The marker 102 may be attached to an article to be protected from unauthorized removal from a business facility (e.g., a retail store). The monitoring system comprises a transmitter circuit 112, a synchronization circuit 114, a receiver circuit 116 and an alarm 118.

During operation, the monitoring system 106-112, 114-118 establishes a surveillance zone in which the presence of the marker 102 can be detected. The surveillance zone is usually established at an access point for the controlled area (e.g., adjacent to a retail store entrance and/or exit). If an article enters the surveillance zone with an active marker 102, then an alarm may be triggered to indicate possible unauthorized removal thereof from the controlled area. In contrast, if an article is authorized for removal from the controlled area, then the marker 102 can be deactivated and/or detached therefrom. Consequently, the article can be carried through the surveillance zone without being detected by the monitoring system and/or without triggering the alarm 118.

The operations of the monitoring system will now be described in more detail. The transmitter circuit 112 is coupled to the antenna 106. The antenna 106 emits transmit (e.g., "Radio Frequency ("RF")) bursts at a predetermined frequency (e.g., 58 KHz) and a repetition rate (e.g., 50 Hz, 60 Hz, 75 Hz or 90 Hz), with a pause between successive bursts. In some scenarios, each transmit burst has a duration of about 1.6 ms. The transmitter circuit 112 is controlled to emit the aforementioned transmit bursts by the synchronization circuit 114, which also controls the receiver circuit 116. The receiver circuit 116 is coupled to the antenna 108. The antenna 106, 108 comprises close-coupled pick up coils of N turns (e.g., 100 turns), where N is any number.

When the marker 102 resides between the antennas 106, 108, the transmit bursts transmitted from the transmitter 112, 108 cause a signal to be generated by the marker 102. In this regard, the marker 102 comprises an Acousto-Magnetic ("AM") element 110 disposed in a marker housing 126. The transmit bursts emitted from the transmitter 112, 106 cause the AM element 110 to generate a response at a resonant frequency (e.g., 58 KHz). As a result, a resonant response signal is produced with an amplitude that decays exponentially over time.

The synchronization circuit 114 controls activation and deactivation of the receiver circuit 116. When the receiver circuit 116 is activated, it detects signals at the predetermined frequency (e.g., 58 KHz) within first and second detection windows. In the case that a transmit burst has a duration of about 1.6 ms, the first detection window will have a duration of about 1.7 ms which begins at approximately 0.4-1.0 ms after the end of the transmit burst. During the first detection window, the receiver circuit 116 integrates any signal at the predetermined frequency which is present. In order to produce an integration result in the first detection window which can be readily compared with the integrated signal from the second detection window, the signal emitted by the marker 102 should have a relatively high amplitude (e.g., greater than or equal to about 1.5 nanowebers (nWb)).

After signal detection in the first detection window, the synchronization circuit 114 deactivates the receiver circuit 116, and then re-activates the receiver circuit 116 during the second detection window which begins at approximately 6 ms after the end of the aforementioned transmit burst. During the second detection window, the receiver circuit 116 again looks for a signal having a suitable amplitude at the predetermined frequency (e.g., 58 kHz). Since it is known that a signal emanating from the marker 102 will have a decaying amplitude, the receiver circuit 116 compares the amplitude of any signal detected at the predetermined frequency during the second detection window with the amplitude of the signal detected during the first detection window. If the amplitude differential is consistent with that of an exponentially decaying signal, it is assumed that the signal did, in fact, emanate from a marker between antennas 106, 108. In this case, the receiver circuit 116 issues an alarm 118.

The transmitter and receiver circuits 112, 118 may also be configured to act as an RFID reader. In these scenarios, the transmitter 112 transmits an RFID interrogation signal for purposes of obtaining RFID data from the active marker 102. The RFID data can include, but is not limited to, a unique identifier for the active marker 102. In other scenarios, these RFID functions are provided by devices separate and apart from the transmitter and receiver circuits 112, 118.

Figure 2:
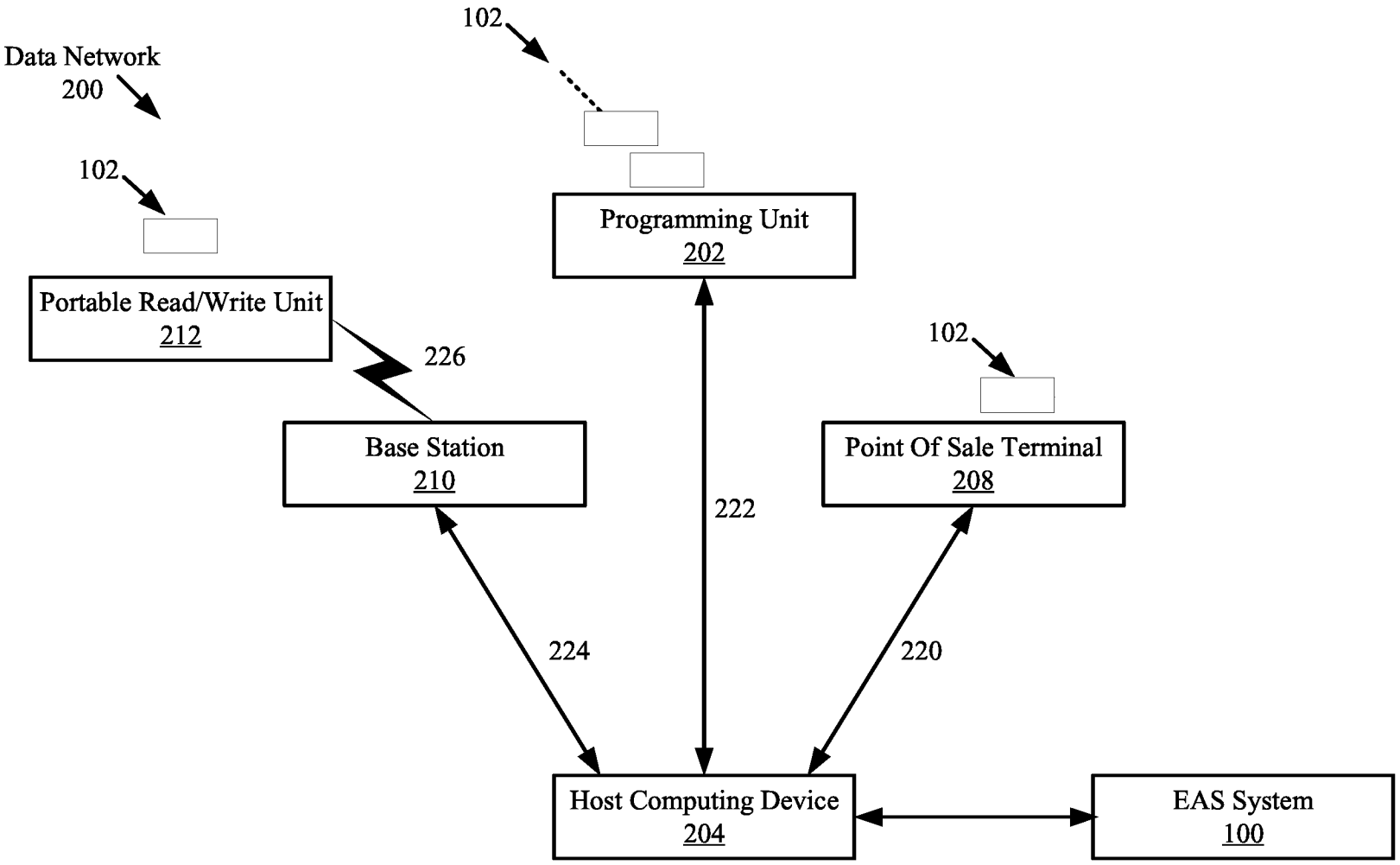
FIG. 2 is an illustration of a data network employing the EAS system of FIG. 1.

Referring now to FIG. 2, there is provided a schematic illustration of an exemplary architecture for a data network 200 in which the EAS system 100 is employed. Data network 200 comprises a host computing device 204 which stores data concerning at least one of merchandise identification, inventory, and pricing. The host computing device 204 can include, but is not limited to, a server, a personal computer, a desktop computer, and/or a laptop computer.

A first data signal path 220 allows for two-way data communication between the host computing device 204 and a POS terminal 208. A second data signal path 222 permits data communication between the host computing device 204 and a programming unit 202. The programming unit 202 is generally configured to write product identifying data and other information into memory of the marker 102. Marker programming units are well known in the art, and will not be described herein. Any known or to be known marker programming unit can be used herein without limitation.

A third data signal path 224 permits data communication between the host computing device 204 and a base station 210. The base station 210 is in wireless communication with a portable read/write unit 212. Base stations are well known in the art, and will not be described herein. Any known or to be known base station can be used herein without limitation.

The portable read/write unit 212 reads data from the markers for purposes of determining the inventory of the retail store, as well as writes data to the markers. Data can be written to the EAS markers when they are applied to articles of merchandise. Portable read/write units are well known in the art, and will not be described herein. Any known or to be known portable read/write unit can be used herein without limitation.

In general, the POS terminal 208 facilitates the purchase of articles from the retail store. POS terminals and purchase transactions are well known in the art, and therefore will not be described herein. Any known or to be known POS terminal and purchase transaction can be used herein without limitation. The POS terminal can be a stationary POS terminal or a mobile POS terminal.

As should be understood, alarm issuance of the EAS system 100 is not desirable when the item to which the marker 102 is coupled has been successfully purchased. Accordingly, the POS terminal 102 includes a marker deactivator. Upon a successful completion of a purchase transaction, a marker deactivation process is initialized. The marker deactivation process involves: communicating a deactivation command from the POS terminal 208 (or other RFID enabled device) to the marker 102; receiving the deactivation command at the marker 102; and perform operations by the marker's communications element to deactivate the AM element thereof. At this time, the marker is considered a deactivated marker. The deactivated marker is not responsive to the electromagnetic field emitted from the transmitter circuit 112, 106.

Illustrative Marker Architectures

The marker 102 of FIG. 1 can have many different structures depending on a given application. Illustrative marker architectures will be described below. Marker 102 can have the same or substantially similar architecture as any one of the markers discussed herein.

Figure 3:
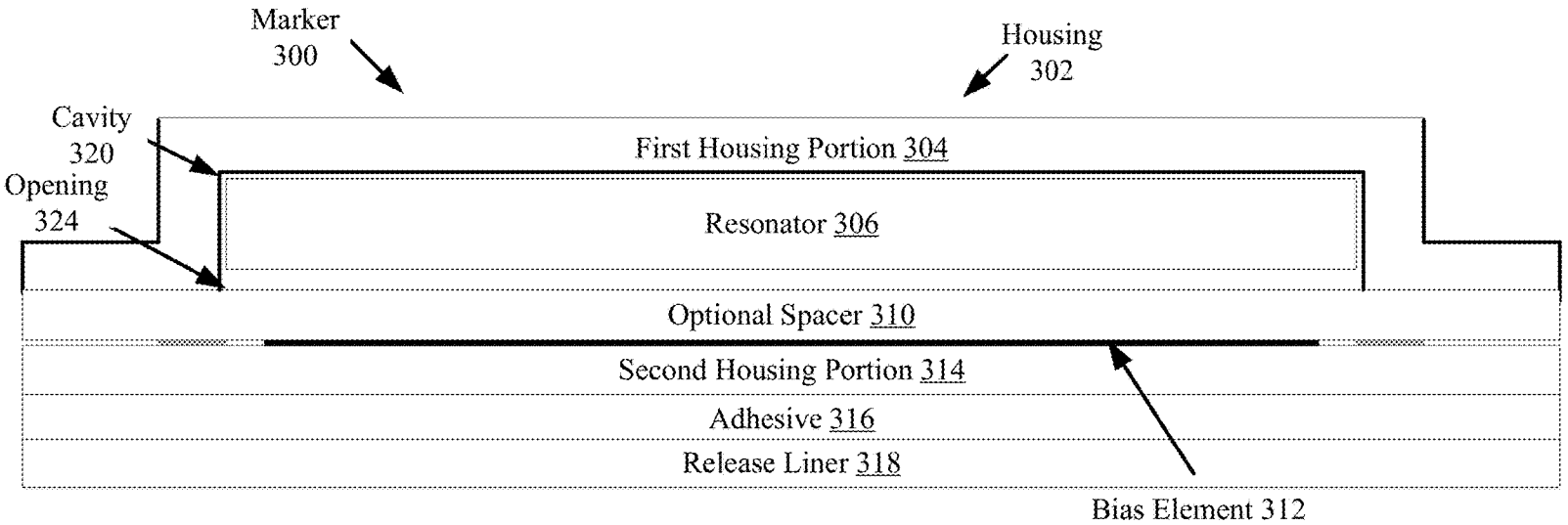
FIG. 3 (Prior Art)
FIG. 3 is an illustration of an illustrative conventional marker.

Referring now to FIG. 3, there is provided an illustration of an illustrative conventional marker 300. The conventional marker 300 comprises a housing 302 formed of a first housing portion 304 and a second housing portion 314. The housing 302 can include, but is not limited to, a high impact polystyrene. An adhesive 316 and release liner 318 are disposed on the bottom surface of the second housing portion 314 so that the marker 300 can be attached to an article (e.g., a piece of merchandise or product packaging).

A cavity 320 is formed in the first housing portion 304. A resonators 306 is disposed in the cavity 320. The resonator 306 has a generally rectangular shape and a planar cross-sectional profile. A spacer 310 is optionally disposed so as to seal an opening 324 of the cavity 320 whereby the resonator 306 is securely disposed and retained in the cavity 320. The spacer 310 can include, but is not limited to, a low density polyethylene.

A bias element 312 is disposed between the spacer 310 and the second housing portion 314. The bias element 312 includes, but is not limited to, an iron-based semi-hard magnet. The spacer 310 is optionally provided so that the physical spacing of and between the bias element 312 and the resonator 308 can be maintained. In FIG. 3, the bias element 312 is shown as being thinner than the resonator 308. This is not drawn to scale. Typically, the bias element 312 has a thickness that is the same as or greater than the thickness of the resonator 308, as shown in FIG. 3.

Figure 4:
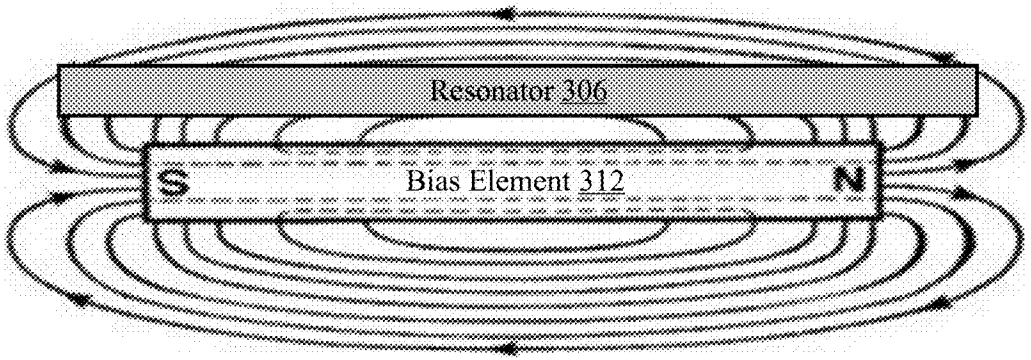
FIG. 4 (Prior Art)
FIG. 4 is an illustration of the magnetic flux lines of the bias element of FIG. 3.

FIG. 4 shows the magnetic flux lines of the bias element 312 being applied to the resonator 306. As shown in FIG. 4, the resonator 306 is located in the middle of the magnetic field. In effect, the magnetic flux lines run generally normal to the length of the resonator. Consequently, the resonator 306 is pulled towards the bias element 312.

Notably, the conventional marker 300 suffers from certain drawbacks. For example, conventional deactivation processes are used to deactivate the conventional marker 300. These conventional deactivation processes are not convenient for self or mobile checkout due to high power and complexity of the deactivation electronics required to deactivate the conventional markers. Many attempts have been made to find alternative solutions to deactivate EAS security tags or markers without success.

The present solution overcomes these drawbacks of the conventional marker 300. The manner in which the drawbacks of the conventional marker 300 are overcome by the present solution will be become evident as the discussion progresses.

Figure 5:
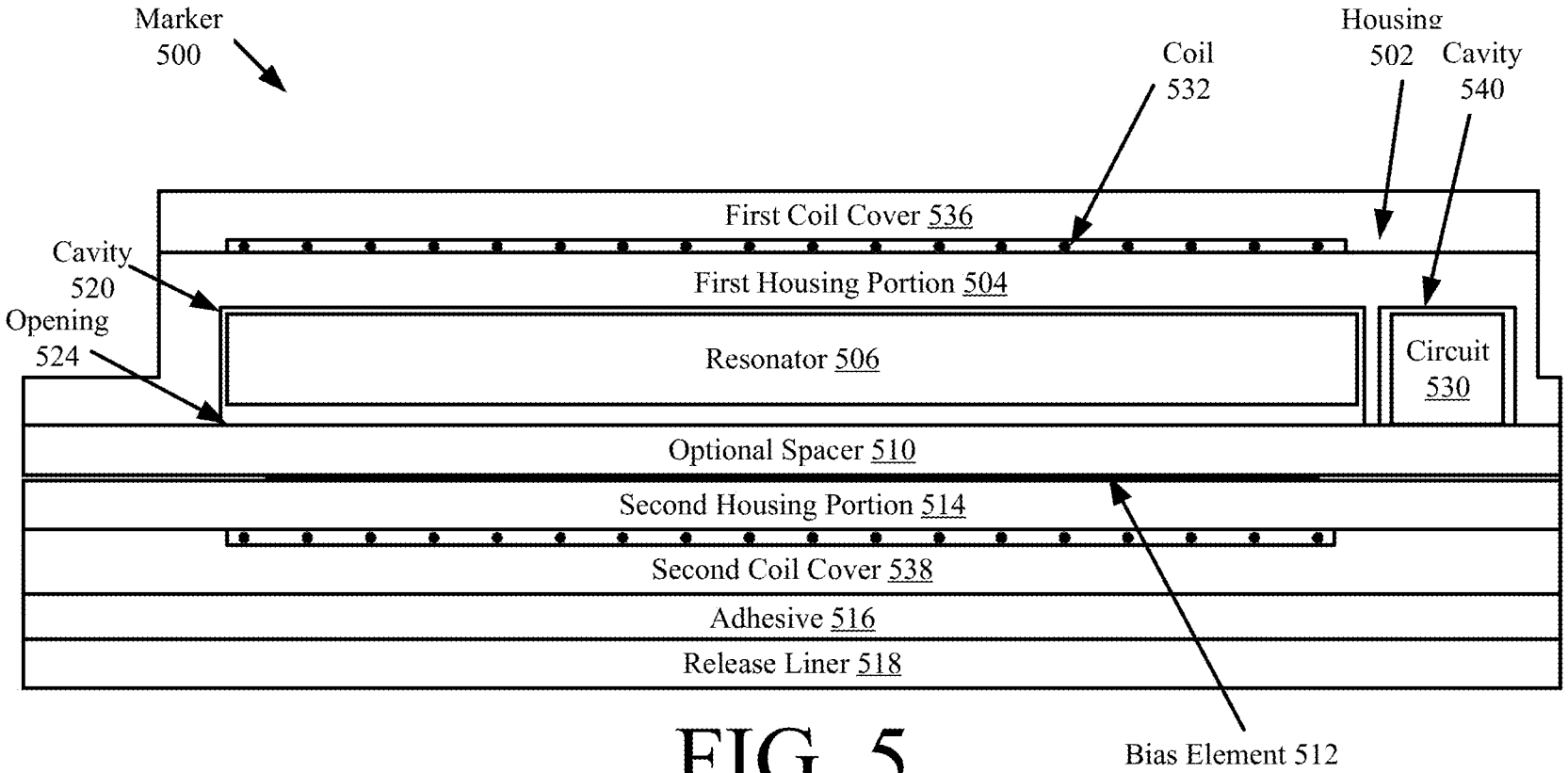
FIG. 5 is an illustration of an illustrative architecture for a marker with an internal deactivation feature.

Referring now to FIG. 5, there is provided an illustration of an architecture for a marker 500 shown in FIG. 5. Marker 500 is not limited to the structure shown in FIG. 5. The marker 500 can have any security tag, label or marker architecture depending on a given application.

As shown in FIG. 5, marker 500 comprises a housing 502 formed of a first housing portion 504 and a second housing portion 514. The housing 502 can include, but is not limited to, a high impact polystyrene. Optionally, an adhesive 516 and release liner 518 are disposed on the bottom surface of the marker 500 so that the marker can be attached to an article (e.g., a piece of merchandise or product packaging).

Figure 6:
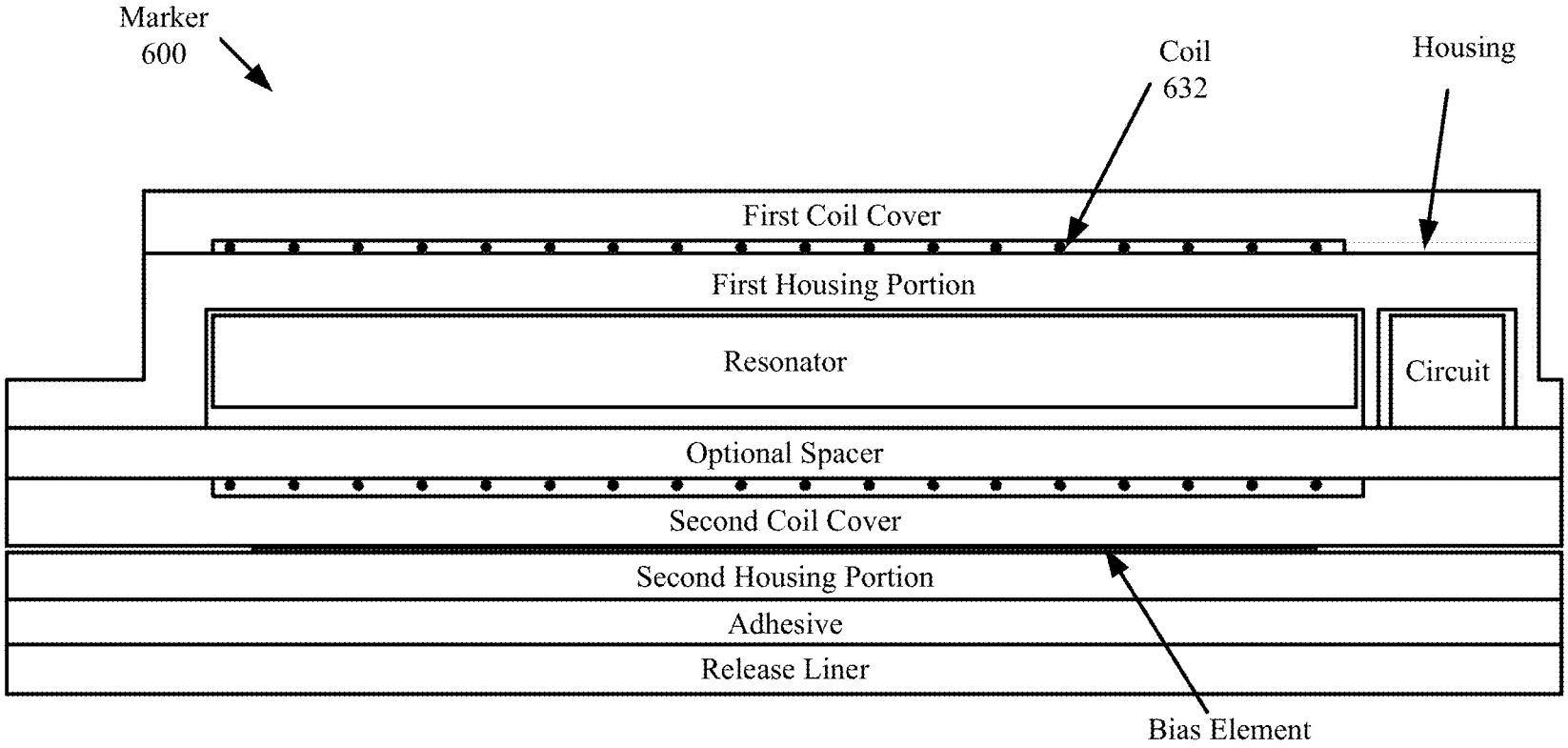
FIG. 6 is an illustration of another illustrative architecture for a marker with an internal deactivation feature.
Figure 7:
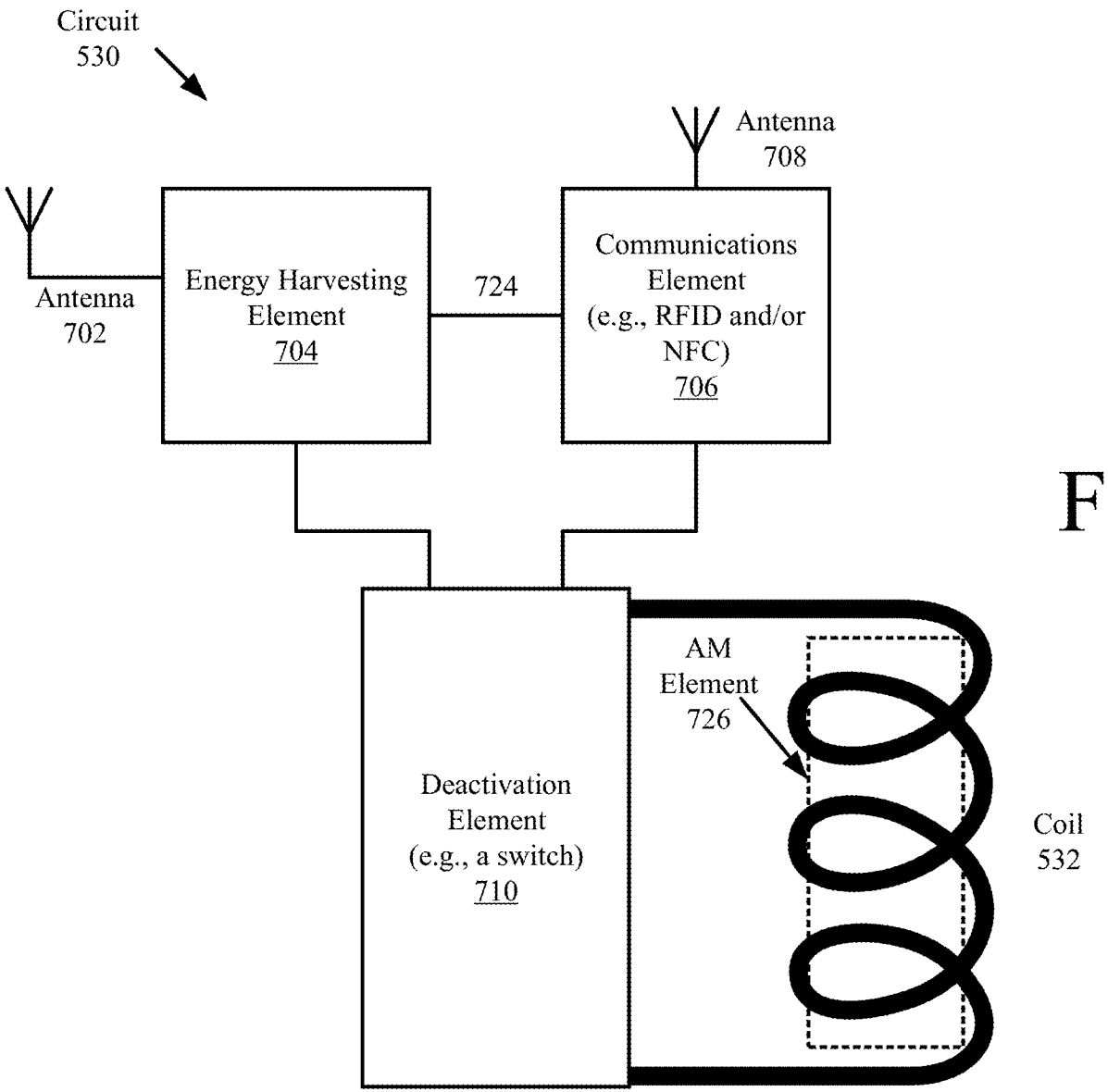
FIG. 7 is a diagram of the circuit shown in FIG. 5.

Two cavities 520, 540 are formed in the first housing portion 504. A resonator 506 is disposed in a first cavity 520, and a circuit 530 is disposed in a second cavity 540. A more detailed diagram of the circuit 530 is provided in FIG. 7. As shown in FIG. 7, the circuit 530 generally comprises a deactivation element 710 connected in series with a coil 532. In some scenarios, the coil 532 is disposed around the resonator 506 and the bias element 512, as shown in FIG. 5. However, in other scenarios, the coil is disposed around the resonator but not the bias element, as shown in FIG. 6. The coil is covered by first and second coil covers 536, 538. The deactivation element 710 includes, but is not limited to, a switch which is normally in an open position. During operation, the switch is selectively closed so as to short the coil 532, whereby the marker 500 becomes deactivated. The shorted coil prevents the resonator from receiving transmit bursts emitted from an EAS system (e.g., EAS system 100 of FIG. 1). In effect, the resonator 506 does not vibrate in response to the transmit bursts.

The circuit 530 also comprises a communications element 706 which is powered by an energy harvesting element 704. Energy harvesting circuits are well known in the art, and therefore will not be described herein. Any known or to be known energy harvesting circuit can be used herein without limitation. Such known energy harvesting circuits are described in U.S. patent application Ser. Nos. 15/833,183 and 15/806,062. In some scenarios, the energy harvesting element 704 is configured to collect Radio Frequency ("RF") energy or Near Field Communication ("NFC") energy via antenna 702 and charge an energy storage device (e.g., a capacitor) using the collected RF or NFC energy. The stored energy enables operations of the communications element 706. An output voltage of the energy storage device is supplied to the communications element 706 via connection 724.

The communications element 706 is configured to act as a transponder in connection with the article identification aspects of the EAS system (e.g., EAS system 100 of FIG. 1). In this regard, the communications element 706 stores multi-bit identification data and emits an identification signal corresponding to the stored multi-bit identification data. The identification signal is emitted in response to the reception of the interrogation signal (e.g., the interrogation signal transmitted from the antenna pedestals 112, 116 of FIG. 1, POS terminal 208 of FIG. 2, and/or portable read/write unit 212 of FIG. 2). In some scenarios, the transponder circuit of the communications element 706 is the model 210 transponder circuit available from Gemplus, Z. I. Athelia III, Voie Antiope, 13705 La Ciotat Cedex, France. The model 210 transponder circuit is a passive transponder which operates at 13 MHz and has a considerable data storage capability.

The communications element 706 is also configured to facilitate the deactivation of the marker 500. The marker is deactivated when the AM element 726 (i.e., resonator 506 and/or bias element 512) is deactivated. The AM element deactivation is achieved via a deactivation element 710 connected to the coil 532. The deactivation element 710 is generally configured to selectively short the coil 532 so that the resonator 506 does not receive energy emitted from an EAS system 100. The coil shorting is performed in response to the communications element reception of a marker deactivation signal (e.g., the marker deactivation signal transmitted from the antenna pedestals 112, 116 of FIG. 1, POS terminal 208 of FIG. 2, and/or portable read/write unit 212 of FIG. 2).

In some scenarios, the deactivation element 710 is designed to switch states when power is supplied thereto from the communications element 706 and remain in the new state even when the power is removed. The deactivation element 710 includes, but is not limited to, a latching switch. Latching switches are well known in the art, and therefore will not be described in detail herein. Any known or to be known latching switch can be used herein without limitation.

The latching switch is designed to normally be in its open position, transition from its open position to a closed position when power is supplied thereto, and remain in its closed position when power is removed. In the closed position, a closed circuit is formed between the deactivation element 710 and the coil 532. When a closed circuit is formed between the deactivation element 710 and the coil 532, the coil 532 is shorted such that the marker 500 becomes deactivated.

In some cases, the marker may be a re-usable marker. The re-usable marker is able to be returned to its open position in response to the marker's reception of an activation signal from an external device. In the open position, an open circuit is formed between the deactivation element 710 and the coil 532. When an open circuit is formed between the deactivation element 710 and the coil 532, the coil 532 is no longer shorted such that the marker 500 becomes activated.

Figure 8:
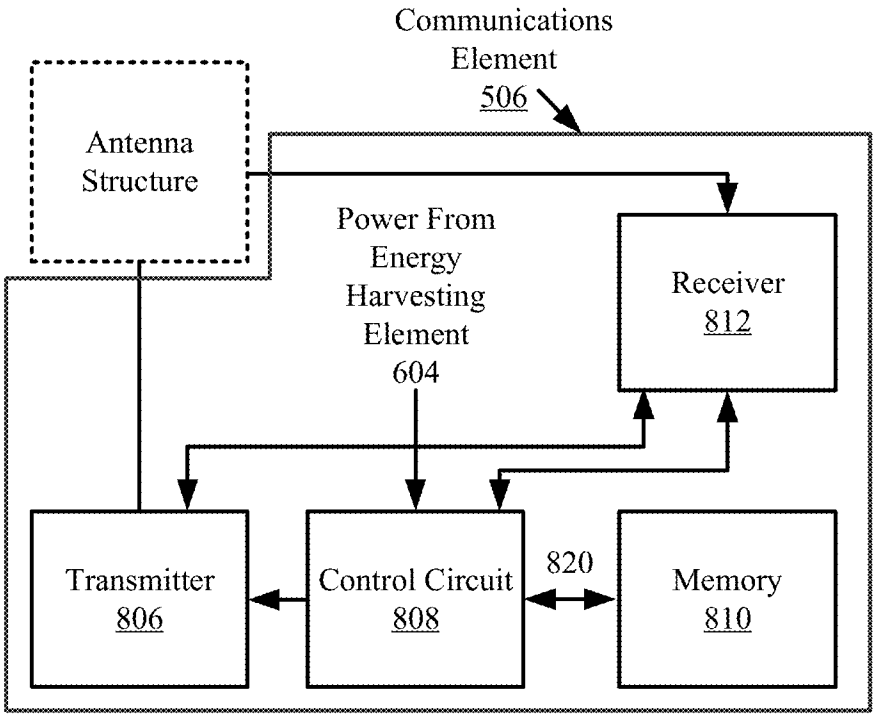
FIG. 8 is a block diagram of the communications element shown in FIG. 5.

Referring now to FIG. 8, there is provided a block diagram of an exemplary architecture for the communications element 506. The communications element 506 may include more or less components than those shown in FIG. 8. However, the components shown are sufficient to disclose an illustrative embodiment implementing the present solution. Some or all of the components of the communications element 506 can be implemented in hardware, software and/or a combination of hardware and software. The hardware includes, but is not limited to, one or more electronic circuits. The electronic circuits can include, but are not limited to, passive components (e.g., resistors and capacitors) and/or active components (e.g., amplifiers and/or microprocessors). The passive and/or active components can be adapted to, arranged to and/or programmed to perform one or more of the methodologies, procedures, or functions described herein.

The communications element 506 comprises a transmitter 806, a control circuit 808, memory 810 and a receiver 812. Notably, components 806 and 812 are coupled to an antenna structure 808 when implemented in the marker 500. As such, an antenna structure is shown in FIG. 8 as being external to the communications element 506. The antenna structure is tuned to receive a signal that is at an operating frequency of the EAS system (e.g., EAS system 100 of FIG. 1). For example, the operating frequency to which the antenna structure is tuned may be 13 MHz.

The control circuit 808 controls the overall operation of the communications element 506. Connected between the antenna structure and the control circuit 808 is a receiver 812. The receiver 812 captures data signals carried by a carrier signal to which the antenna structure is tuned. In some scenarios, the data signals are generated by on/off keying the carrier signal. The receiver 812 detects and captures the on/off keyed data signal.

Also connected between the antenna structure and the control circuit 808 is the transmitter 806. The transmitter 806 operates to transmit a data signal via the antenna structure. In some scenarios, the transmitter 806 selectively opens or shorts at least one reactive element (e.g., reflectors and/or delay elements) in the antenna structure to provide perturbations in an RFID interrogation signal, such as a specific complex delay pattern and attenuation characteristics. The perturbations in the interrogation signal are detectable by a marker reader (e.g., the EAS system 100 of FIG. 1, portable read/write unit 212 of FIG. 2, the POS terminal 208 of FIG. 2, and/or the programming unit 202 of FIG. 2).

The control circuit 808 may store various information in memory 810. Accordingly, the memory 810 is connected to and accessible by the control circuit 808 through electrical connection 820. The memory 810 may be a volatile memory and/or a non-volatile memory. For example, memory 812 can include, but is not limited to, a Radon Access Memory ("RAM"), a Dynamic RAM ("DRAM"), a Read Only Memory ("ROM") and a flash memory. The memory 810 may also comprise unsecure memory and/or secure memory.

The memory 810 can be used to store identification data which may be transmitted from the communications element 506 via an identification signal. The memory 810 may also store other information received by receiver 812. The other information can include, but is not limited to, information indicative of the handling or sale of an article.

The components 806, 808, 812 are connected to the energy harvesting element 804 which accumulates power from a signal induced in an antenna 802 as a result of the reception of an RFID signal. The energy harvesting element 804 is configured to supply power to the transmitter 806, control circuit 808, and receiver 812. The energy harvesting element 804 may include, but is not limited to, a storage capacitor.

Illustrative Method for Operating a Marker

Figure 9:
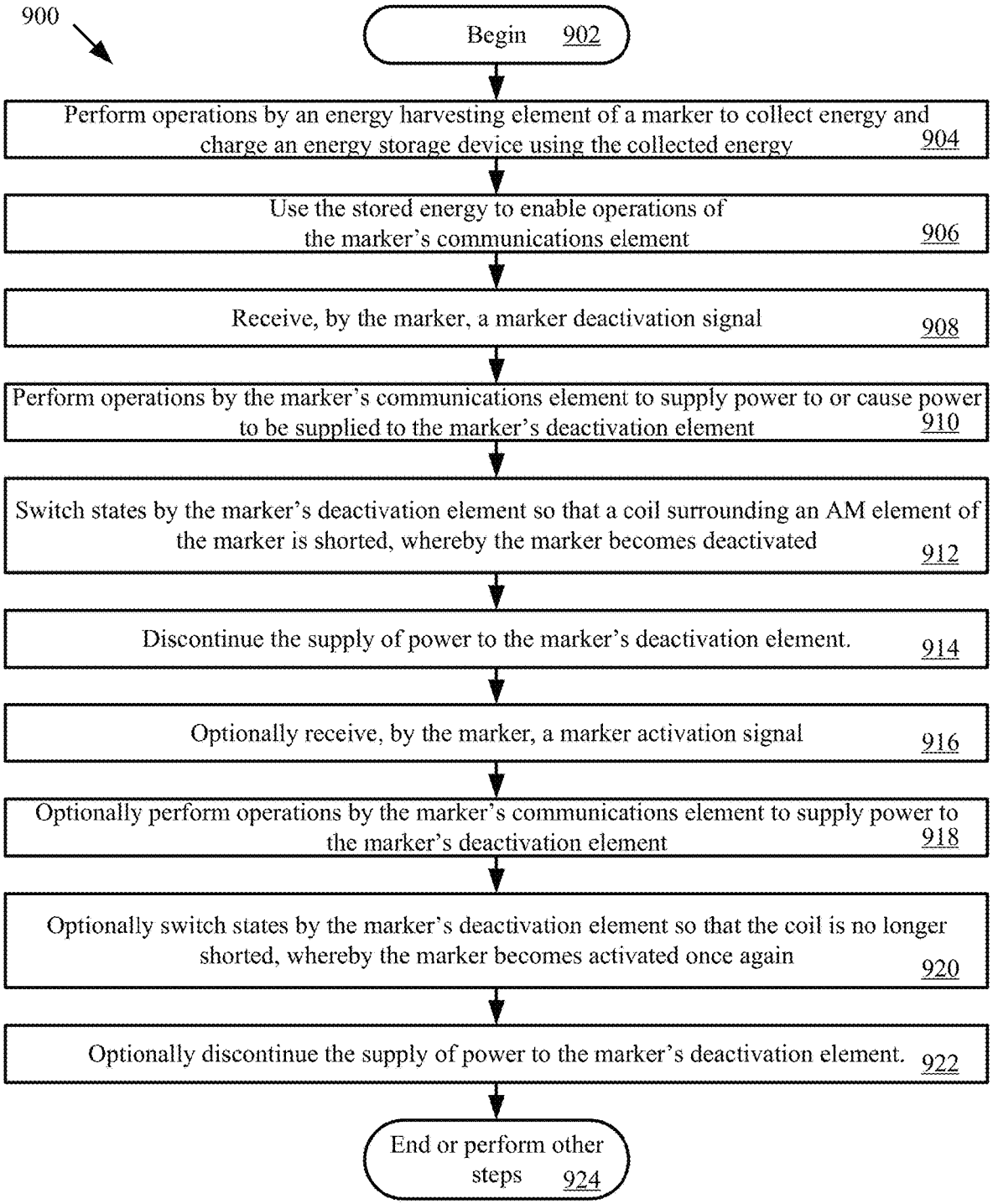
FIG. 9 is a flow diagram of an illustrative method for operating a marker.

Referring now to FIG. 9, there is provided a flow diagram of an illustrative method 900 for operating a marker (e.g., marker 102 of FIG. 1, marker 500 of FIG. 5, or marker 600 of FIG. 6). Method 900 begins with 902 and continues with 904 where an energy harvesting element (e.g., energy harvesting element 404 of FIG. 4) performs operations to collect energy (e.g., RF energy and/or AM energy) and charge an energy storage device (e.g., a capacitor) using the collected energy. The stored energy is used in 906 to enable operations of the marker's communications element (e.g., communications element 706 of FIG. 7). In 908, the marker receives a marker deactivation signal transmitted from an external device (e.g., antenna pedestals 112, 116 of FIG. 1, POS terminal 208 of FIG. 2, and/or portable read/write unit 212 of FIG. 2). In response to the marker deactivation signal's reception, the marker's communications element performs operations to set a status bit value to a deactivate value (e.g., "1"), supply power to a deactivation element (e.g., deactivation element 710 of FIG. 7), and/or cause power to be supplied to a deactivation element (e.g., deactivation element 710 of FIG. 7) via the energy harvesting element. When power is supplied to the deactivation element, it switches states. Consequently, a coil (e.g., coil 532 of FIG. 5 or 632 of FIG. 6) is shorted whereby the marker becomes deactivated. Next in 914, the communications element stops supplying power to the deactivation element. Notably, the deactivation element remains in its new state after power is no longer supplied thereto.

In some cases, the marker may be a reusable marker. Thus, it may be desirable to re-activate the marker at a later time. In this case, method 900 continues with optional 916-922. 916-918 involve: receiving, by the marker, a marker activation signal; and performing operations by the marker's communications element to set a status bit value to an activate value (e.g., "0") and/or supply power to the marker's deactivation element. As a result, the marker's deactivation element switches states so that the marker's coil is no longer shorted. In effect, the marker once again generates a response to signals emitted from the EAS system. Next in 922, the communications element stops supplying power to the deactivation element. Subsequently, 924 is performed where method 900 ends or other processing is performed (e.g., return to 904).

Although the present solution has been illustrated and described with respect to one or more implementations, equivalent alterations and modifications will occur to others skilled in the art upon the reading and understanding of this specification and the annexed drawings. In addition, while a particular feature of the present solution may have been disclosed with respect to only one of several implementations, such feature may be combined with one or more other features of the other implementations as may be desired and advantageous for any given or particular application. Thus, the breadth and scope of the present solution should not be limited by any of the above described embodiments. Rather, the scope of the present solution should be defined in accordance with the following claims and their equivalents.

What is claimed is:

1. A method for operating a marker, comprising:

receiving, by a communications element of an electronic circuit internal to the marker, a marker deactivation signal from an external device; and responsive to the marker deactivation signal, disabling an Acousto-Magnetic ("AM") component of the marker by causing a coil surrounding at least a resonator of the AM component to be shorted using a deactivation element of the electronic circuit that switches from an open state to a closed state when power is supplied thereto.

2. The method according to claim 1, wherein the marker deactivation signal is transmitted from a Point Of Sale ("POS") terminal.

3. The method according to claim 1, wherein the marker deactivation signal is transmitted in response to a successful purchase transaction of an article to which the marker is coupled.

4. The method according to claim 1, wherein the communications element is a Radio Frequency Identification ("RFID") enabled device or a Near Field Communication ("NFC") enabled device.

5. The method according to claim 1, wherein the marker comprises an Electronic Article Surveillance ("EAS") marker.

6. The method according to claim 1, wherein the deactivation element comprises a switch connected directly to the coil.

7. The method according to claim 1, wherein the deactivation element comprises a switch configured to (a) transition from an open position to a closed position when power is supplied thereto, and (b) remain in the closed position when power is removed.

8. The method according to claim 1, further comprising discontinuing the supply of power to the deactivation element.

9. The method according to claim 8, further comprising:

receiving, by the communications element, a marker activation signal transmitted from the external device or another external device; and responsive to the marker activation signal's reception, supplying power to the deactivation element so that the deactivation element switches from the closed state to the open state.

10. The method according to claim 9, further comprising discontinuing the supply of power to the deactivation element after the deactivation element switches to the open state, wherein the deactivation element remains in the open state when power is removed.

11. A marker, comprising:

an Acousto-Magnetic ("AM") component comprising a resonator;

an electronic circuit comprising a coil disposed around the resonator of the AM component;

a communications element configured to receive a marker deactivation signal transmitted from an external device, and cause power to be supplied to a deactivation element so that the deactivation element switches from an open state to a closed state; and the deactivation element disabling the AM component by causing the coil to be shorted when switched to the closed state.

12. The marker according to claim 11, wherein the marker deactivation signal is transmitted from a Point Of Sale ("POS") terminal.

13. The marker according to claim 11, wherein the marker deactivation signal is transmitted in response to a successful purchase transaction of an article to which the marker is coupled.

14. The marker according to claim 11, wherein the communications element is a Radio Frequency Identification ("RFID") enabled device or a Near Field Communication ("NFC") enabled device.

15. The marker according to claim 11, wherein the marker comprises an Electronic Article Surveillance ("EAS") marker.

16. The marker according to claim 11, wherein the deactivation element comprises a switch connected directly to in series with the coil.

17. The marker according to claim 11, wherein the deactivation element comprises a switch configured to (a) transition from an open position to a closed position when power is supplied thereto, and (b) remain in the closed position when power is removed.

18. The marker according to claim 11, wherein the communications element is further configured to cause the supply of power to the deactivation element to be discontinued.

19. The marker according to claim 18, wherein the communications element is further configured to:

receive a marker activation signal transmitted from the external device or another external device, and supplying power to the deactivation element in response to the marker activation signal's reception, so that the deactivation element switches from the closed state to the open state.

20. The marker according to claim 19, wherein the communications element is further configured to cause the supply of power to the deactivation element to be discontinued after the deactivation element switches to the open state, wherein the deactivation element remains in the open state when power is removed.

* * * * *